United States Patent [19]

Holden

[11] 4,390,585

[45] Jun. 28, 1983

[54] DURABLE FLEXIBLE MEMBRANE AND METHOD OF MAKING SAME

[75] Inventor: Durrell W. Holden, Dublin, Va.

[73] Assignee: Bond Cote of Virginia, Inc., Pulaski, Va.

[21] Appl. No.: 375,339

[22] Filed: May 5, 1982

[51] Int. Cl.[3] ..... B32B 3/00

[52] U.S. Cl. ..... 428/172; 427/209; 427/277; 427/381; 427/389.9; 428/246; 428/251; 428/252; 428/262; 428/265; 428/268; 428/920

[58] Field of Search ..... 428/246, 252, 269, 156, 428/172, 921, 141, 253, 254, 262, 265, 272, 219, 273, 255, 268, 251; 427/277, 278, 389.9, 412, 209, 210, 381, 366, 430.1

[56] References Cited

U.S. PATENT DOCUMENTS

| | | | |
|---|---|---|---|
| 2,930,104 | 3/1960 | Watts et al. | 428/269 |
| 3,620,890 | 11/1971 | Kemmler | 428/246 |
| 4,233,358 | 11/1980 | Jones et al. | 428/246 |
| 4,265,962 | 5/1981 | May | 418/272 |
| 4,291,086 | 9/1981 | Auten | 428/273 |

*Primary Examiner*—James J. Bell

*Attorney, Agent, or Firm*—Mason, Fenwick & Lawrence

[57] ABSTRACT

A flexible membrane having a valuable combination of desirable properties is composed of a generally heavy, dense supporting and reinforcing reticulated base fabric constituted of thick, generally loose bundles of multiple continuous filaments arranged in a mechanically interengated reticular array having an overall weight within the range of about 3–12 oz/yd$^2$ the continuous filaments being of a synthetic polymer having good dimensional stability and high resistance to heat and light; and a solidified base coating composition completely impregnating the interstices of the base fabric and as forming a continuous coating along the opposite sides thereof, the composition having as essential ingredients a PVC resin and a plasticizer therefor in the amount of 35–75% of the resin of a trimellitate ester which exhibits high resistance to separation from the resin and imparts to the coating high flexibility at temperatures at least as low as about −35° F., the amount of the coating composition being preferrably at least about equal in weight to the weight of the base fabric. Preferably, the coating composition exceeds the weight of the base fabric by a factor of two or more, at least one additional layer of such coating composition being applied to each of the opposite surfaces of the coated base fabric and fused into integral relation therewith so as to improve the abrasion resistance, waterproofness, UV resistance, heat resistance and like mechanical properties of the ultimate membrane. The coating composition can contain additional adjuvants of the several types known in the PVC coating field, including supplemental plasticizers, a fire retardant, UV resistance enhancing, opacifying pigment, fungicidal and like agents. In its optimum form, the present membrane exhibits special utility as a roofing fabric of exceptional durability.

20 Claims, 6 Drawing Figures

Fig-1
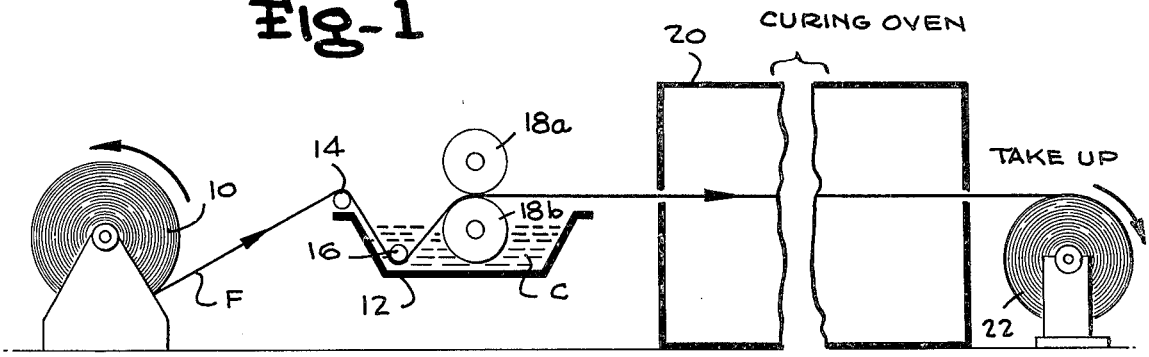
Fig-2
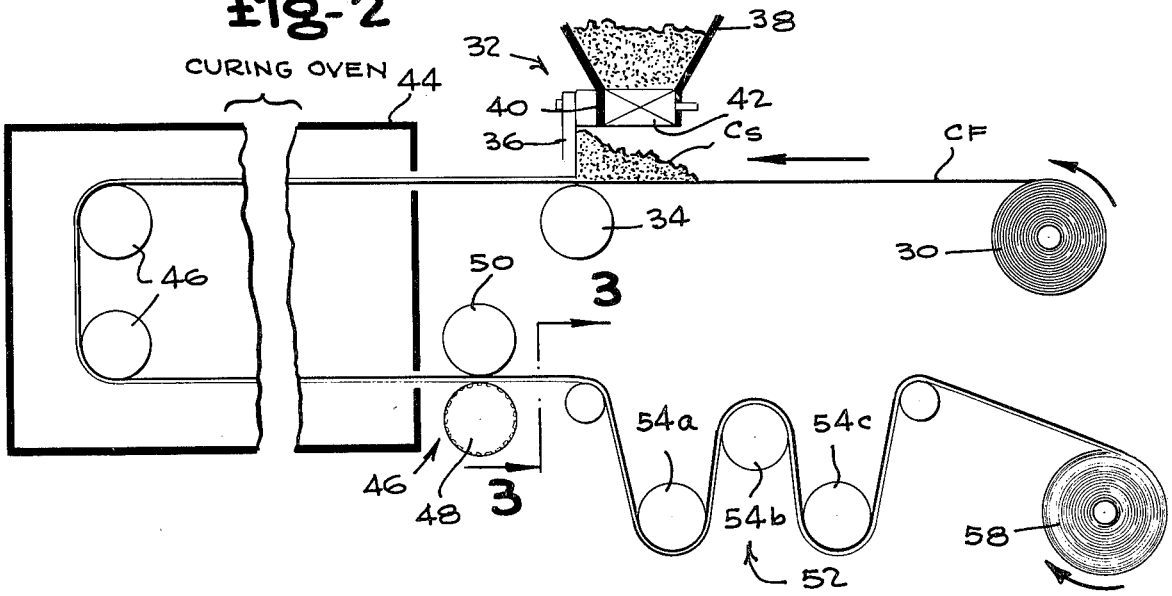
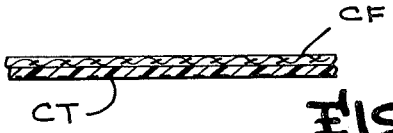
Fig-3

DURABLE FLEXIBLE MEMBRANE AND METHOD OF MAKING SAME

FIELD OF THE INVENTION

This invention relates to the field of flexible coated membranes and is concerned more particularly with a flexible membrane having a dense base or core fabric of multi-filament synthetic polymer yarns disposed in a mechanically interengaged reticulated array, as by weaving or knitting, and impregnated with a polyvinyl chloride (PVC) base resin coating composition. In accordance with the invention, the resin coating composition incorporates a special plasticizing agent for the PVC resin which is selected from the mellitate di- or triesters which exhibit high resistance to diffusion or exodation from the dried resin and imparts to the resin, and thus to the ultimate coated fabric, an unusual degree of flexibility at extremely low temperatures, such as −30° F. or below which is of prime importance in adapting the ultimate membrane for exterior use under severe cimactic conditions.

The membrane of the present invention has as its center or core element a reticulated fabric which serves a supporting and reinforcing function for the subsequently applied PVC base coating composition. The reticulated fabric is constituted of thick, generally loose bundles of a large multiplicity of individual continuous filaments formed of a synthetic polymer of a type having good resistance to heat and light and generally high dimensional stability. Polymers having acceptable characteristics along these lines include nylon, polyester and fiberglass, with polyester being preferred. In general, filaments formed of olefinic resins or of artificial cellulosic materials, such as rayon, acetate or the like, as well as those of acrylic resins, such as orlon, are less suited to the needs of the base fabric of the invention by reason of inherent low strength, susceptibility to degradation upon exposure to heat and light, excessive tendency to elongate under stress or other reasons.

It is important that the yarns constituting the base fabric of the invention have a large generally loose character achieved by grouping many small individual monofilaments, say of 5–15 denier, into bundles ranging from several hundred to several thousand denier overall, a bundle denier of 1000–2000 being here preferred. The bundles should be generally free of twist, although it is acceptable, and even desirable from the standpoint of ease of handle and manipulation, for the bundles to have a so-called "producer's " twist, say of ½ to 1 turn per inch. These large essentially untwisted bundles thus are in a loose, unrestrained condition and thus have a tendency to spread laterally into a rather dense condition when assembled into fabric form, while still providing spaces or interstices therebetween capable of receiving an impregnating resin.

The multi-filament yarn bundle must be assembled into a mechanically interengaged array in which they extend in intersecting generally perpendicular, directions and both weaving and knitting techniques can be employed for this purpose. The number of picks per inch or the size and manipulation of the knitting needles, as the case may be, needs to be selected in correspondence with the size of the multi-filament yarn bundles being fabricated so as to achieve the desired generally dense bulky fabric. For example, using multi-filament bundles containing, say about 200 individual filaments with an overall denier of 1000, a suitable fabric could be woven at a pick count of about 24×26 or for a slightly less dense fabric of a pick count of 18×15. Obviously, an inverse relationship exists between the denier of the multi-filament bundles and the pick count and, for example, using yarn bundles of 2000 overall denier, a pick count of about 12×12 would be appropriate, while if the bundle size was reduced below 1000, the pick count would desirably be appropriately increased.

A suitable base fabric could be fabricated by knitting particularly when an extra yarn is inserted weftwise during the knitting operation, being laid crosswise in the hooks of the knitting needles for this purpose, as is well known in the knitting art. The inserted thread would in this instance preferably be of the same polymeric nature as the remainder of the fabric, although of smaller denier. For example, a tie-down inserted yarn of about 70 denier polyester would be suitable for a knitted fabric of about 18×17 courses and wales per inch.

The reticulated fabrics of the invention requires some type of mechanical interengagement of their component elements during fabrication, such as is achieved by weaving or knitting. Superimposed layers of orthogonally disposed yarn bundles, lacking such mechanical interconnection would not achieve the same result.

A preferred fabric weight is about 6 oz/yd$^2$ but for lower weight products, this amount could be reduced perhaps to 3 or even 2 oz/yd$^2$. At the opposite extreme the base fabric could have a weight of up to about 10–12 oz/yd$^2$ which would, of course, provide a more bulky, thick and mechanically strong fabric. At the preferred 6 oz/yd$^2$ level, the base fabric will have a thickness of about 10–12 mils, and this thickness will naturally change with variation in the fabric weight. Optimally, the base fabric has minimum tear strength of at least about 90 lb/in and a minimum tensile strength of at least about 375–400 lb/in, as tested by the usual instrumentation employed for these measurements operating on specimens of predetermined dimensions according to the test specification.

After the base fabric has been assembled according to a desires set of specifications, it is then ready to be impregnated with the special resin coating composition which constitutes the particular improvement of this invention. The essential ingredients of this coating composition are a PVC resin, normally of dispersion grade inasmuch as the coating is usually applied in the form of a plastisol, in which is incorporated a trimellitate ester plasticizing agent which has been found uniquely suited for the present type of membrane. The PVC resin is used in the form of a finely divided powder and, consequently, is of the so-called dispersion grade known in the art, which is relatively costly due to the measures necessary to achieve its finely divided form. To reduce this expense, a proportion of the dispersion grade PVC resin can be substituted by so-called blending resin which is also of the PVC type, being made, however, by suspension polymerization of other less expensive techniques. The amount of the blending resin can be up to at least about 25% and perhaps up to 50% except where high quality or optimum characteristics are sought. The use of blender resins in this fashion is in itself known in the PVC coating field and the usual practices in this area are normally applicable in the execution of this invention as well. Thus, blender resins are generally known to include copolymers of PVC with other vinyl type monomers, although it is here preferred that the blender resin be likewise constituted wholly of PVC.

The PVC resin is preferably a homopolymer of medium to high molecular weight with an inherent viscosity in the range of about 1.0 minimum to 1.4 maximum.

There are known in the PVC coating field a great variety of types of plasticizing agents for this resin such as the phthalates, phosphates, dibasic acid esters, epoxies, benzoates, citrates, isophthalates, pentaerythritol esters, glycolates, polyesters, chloriated hydrocarbons, cross-linkable polymers and the like, as well as the trimellitate esters, and a critical aspect of the present invention is the discovery that certain trimellitate esters exhibit a unique coaction with the basic PVC resin in achieving the mandatory requirements of the present invention. In general, the trimellitate esters are di- or trialkyl esters of trimellitic acid or 1,2,4-benzenetricarboxylic acid. Obviously, the nature of the alkyl groups of such esters can vary widely and at the present time only limited types and combinations of alkyl groups in such esters are commercially available. Certain of these have been found to qualify in conferring the requisite properties of the invention, while others have not. The variety of compounds in this class available for experimentation is too small and the amount of experimentation needed excessively large to permit absolute definition of the operable trimellitate esters to be delineated and, as an alternative, a functional criterion has been developed and applied.

As mentioned, the membranes of the invention are destined for exterior use and are consequently exposed to ambient climactic conditions which not only vary seasonally in a given locale but diverge greatly from one locale to another, and one of the most demanding properties established for the present membranes is high flexibility under extreme low temperature conditions. Specifically, it is necessary for the present membranes to withstand a full 180° bend on a radius of 1/16 inch, i.e. a 180° bend around a rod of ⅛ inch diameter at temperatures at least as low as about −30° F. without undergoing cracking or crazing even to the extent of fine hairline cracks. In other words, the membranes here must be free of all cracking when bent a full 180° on a 1/16 inch radius at temperatures at least as cold as about −30° F. It has been found that n-octyl, n-decyl trimellitate imparts low temperature flexibility to the PVC resin coating composition meeting this standard as does trioctyl trimellitate. On the other hand, tri-2-ethylhexyl trimellitate (TOTM) when substituted in an otherwise identical composition fails this low temperature flexibility standard when substituted at equal levels, as do conventional PVC plasticizers such as di-octyl phthalate and the like.

It is believed that branched-chain alkyl trimellitate esters do not qualify for the needs of the invention, whereas straight-chain alkyl esters do, provided the length of the alkyl chain is sufficient to achieve useful plasticizing efficiency. At present, a minimum chain length of 6 carbon atoms is believed to be needed and preferably 8 carbon atoms, especially in the case of the di- rather than triesters; the maximum number of carbon atoms is not presently known but can probably equal if not exceed 10–12 in number inasmuch as plasticization tends generally to be improved with increasing chain length, for example, in the phthalate type esters and the same conclusions should apply to the trimellitate category as well. At some point, of course, the chain length would be so great as to increase the molecular weight of the plasticizer above the level capable of easy working during mixing and chain lengths of that extent should normally be avoided.

The amount of the trimellitate ester can vary based on the weight of the PVC resin in the range of 35–75% or higher, both limits being mainly based on practical considerations. Thus, at the lower level, the consistency of the plasticized resin is not appropriate for good mixing, while at the upper limit, so much plasticizer is present that the resin loses strength and becomes excessively dilute. The amount of the plasticizer could likely go as high as 100% of the PVC resin, but above 100%, curing of the resin to a desired consistency will become a problem. A preferred level of the trimellitate ester plasticizing agent is around 50% of the PVC resin.

The coating composition can and normally should include other constituents selected in accordance with the usual practice in the PVC coating field. These can include, without intending to be exhaustive, the following additives in the stated amounts:

| Agent | General Range of Amounts (as % of resin) | Typical Level |
|---|---|---|
| Heat and light stabilizer | 1–4 | about 2 |
| Fire retardant | 10–25 | about 19 |
| UV stabilizer | less than 0.01 | .006 |
| Opacifying pigment | 2–10 | about 4.5 |
| Fungicide | up to about 0.01 | 0.013 |
| Plasticizers | | |
| Epoxy stabilizing type | 1–4 | about 2 |
| Polymeric | 1–4 | about 2 |
| Phosphate | | |
| Flame retarding type | 2–6 | about 4.5 |

Other adjuvants from this art could also be incorporated such as anti-oxidants, colorants, if desired, adhesion promoters, lubricants, anti-static agents, bacteriacides, etc. Information regarding these as well as the conventional ingredients discussed above can be found by reference to any of the handbooks available in this field, such as charts provided for many of the above identified types of ingredients in the annually issued *Modern Plastics Encyclopedia* as well as the test, *Polyvinyl Chloride* by Sarvetnick, the Reinhold Plastics Application Series, copyright 1969 by Reinhold Book Company.

From these sources, specific compounds may be readily selected for each of the above named categories but, for sake of illustration, the following compounds have been employed for the stated purpose in the practice of the present invention with good results and are preferred.

| | |
|---|---|
| Fire retardant | Antimony oxide |
| Heat and light stabilizer | Epoxidized soybean oil |
| Heat and light stabilizer | Berium-cadmium-zinc |
| UV stabilizer | 2-hydroxy-4-n-oxtyl-benzophenone |
| Pacifying pigment | Titanium dioxide |
| Fungicide | 2-n-oxtyl-4-isothiazoline |
| Other plasticizers | Epoxidized soybean oil<br>Polymeric polyester<br>Tricresyl phosphate |

As is known, certain of the conventional materials identified above are commonly used in association with one another. For example, the epoxy plasticizer is typically associated with the berium-cadmium-zinc-heat stabilizing agent, while the phosphate type plasticizer cooperates with the antimony oxide flame retardant agent. These practices might usefully be taken advantage of in the execution of the invention.

The mixture of ingredients selected to make up the composition of the invention are mixed together into the form of a plastisol, and for this purpose a small amount of a diluent is incorporated in order to assist in bringing the solid ingredients into plastisol condition. Any common inexpensive organic solvent, such as mineral or petroleum spirits or the like can serve this purpose and can range in amount usually from about 1 up to about 5% by weight with about 3% being a typical useful level. Mixing is achieved utilizing any conventional high speed mixing equipment which employs shear blades to subject the ingredients to high speed shearing action during mixing. A particular mixer found useful for this purpose is a so-called Cowles dissolver. After mixing, the resultant plastisol can have a viscosity in the range of about 10,000 to 15,000 cps although certainly some variation outside these limits is possible dependent upon variations in the number and amounts of the other ingredients of the mixture.

A preferred process for producing the durable flexible membranes of the invention is illustrated in the accompanying drawings which represent a two-stage process that has been found effective and convenient. In the drawings, FIG. 1 represents the first stage in which the base fabric is impregnated to saturation with the base coating composition and then cured in a curing oven to an intermediate condition permitting it to be readily handled. The intermediately coated base fabric in the preferred practice of the invention then has applied to the opposite surfaces thereof at least one and preferably more than one, specifically three, additional applied coatings of the same composition by repeatedly passing the same through the supplemental coating operation as illustrated in FIGS. 2 and 3 of the drawings, with inversion of the material being coated at the appropriate stage in order to achieve additional coatings on both surfaces of the material.

BRIEF DESCRIPTION OF THE DRAWINGS

In the drawings:

FIG. 1 is a diagrammatic view in side elevation of the first coating stage used in the process of the invention;

FIG. 2 is a similar diagrammatic side elevational view of the second stage used in the process of the invention for applying a coating to one side of the intermediate stage product as produced with the process steps of FIG. 1;

FIG. 3 is an enlarged cross-sectional detailed view of the coated fabric generally as according to the second stage process of FIG. 2, taken substantially along line 3—3 of FIG. 2;

Figure 4:
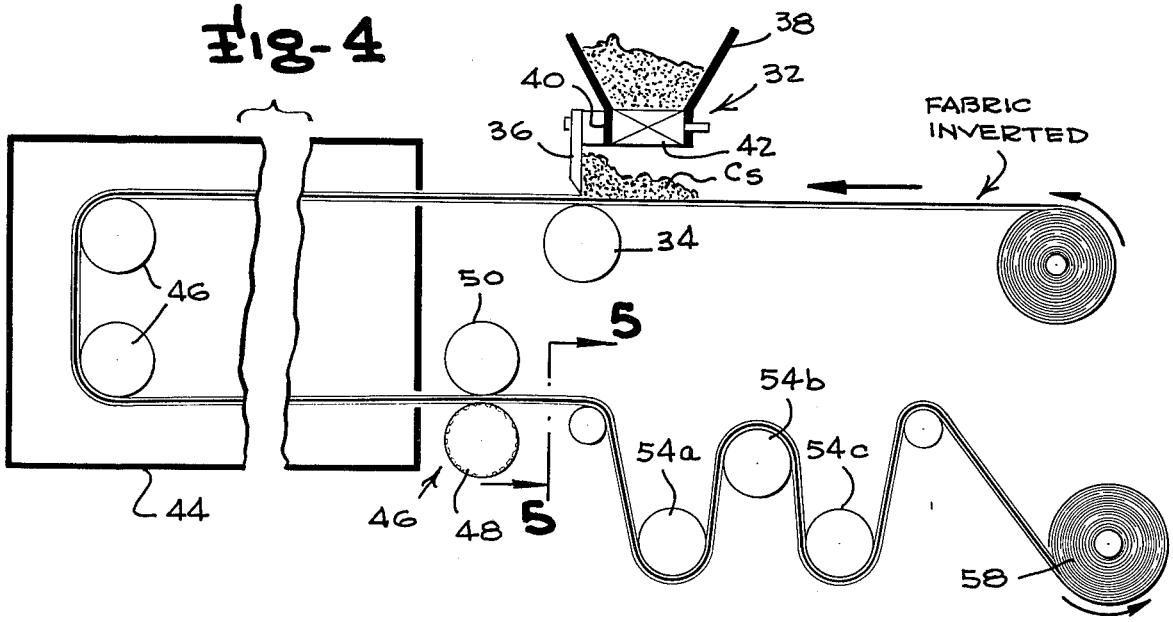
FIG. 4 is a view similar to FIG. 2 but showing the fabric being passed in inverted condition through the same second stage unit of FIG. 2, the equipment of the second stage being otherwise the same and designated by the same numerical designations as in FIG. 2.

As is indicated in FIG. 1, a previously prepared roll of the base fabric, having a construction of the type described above, is mounted on a journal for freely unwinding, and the fabric F from this supply roll 10 is led from this roll to an immersion tank 12 passing over an idler guide roll 14 into a fully immersed state within the contents of receptacle 12, an immersion roll 16 being provided somewhat below the surface of the coating bath in receptacle 12 for that purpose, the coating bath being indicated for convenience as C. After being completely and fully immersed within the coating composition contained in receptacle 12, the base fabric F is passed through the nips of a set of pressure rollers 18*a*, 18*b*, the lower one of which 18*b* may be disposed so as to be partially immersed within coating composition C, while the nip, however, is situated well above the upper level of the composition. The pressure roller set 18*a*, 18*b* is set in terms of the clearance therebetween to remove any excess amount of coating composition that has been picked up by the fabric during its passage through the coating material. It is generally accepted that a fabric can pick up by means of immersion not more than about its own weight of coating composition, and it is preferred here that the initial coating step of the base fabric be carried out in such a way as to apply to the base fabric approximately 100% of its weight of the coating composition. Obviously, the actual amount of solid material deposited upon the coated base fabric after drying will be determined by the solids concentration of the coating plastisol, but as the above description of the latter suggests, it is preferred that the solids concentration of the plastisol be maintained high and indeed near the maximum possible value and around 98% solids, the plasticizing agents being included as solids for this purpose, the only volatile ingredient being the diluent. Less of the coating composition can be applied at this stage, especially where additional layers of the same are to be applied in the second stage coating operation, but in any case the base fabric should be generally completely saturated with the coating composition so that its interstices or internal open spaces are filled as completely as possible with the coating composition, but both side faces of the base fabric carry substantially continuous coatings of the coating composition therealong. The pressure roller set 18*a*, 18*b* will assist in forcing the coating composition fully into and throughout the interior of the base fabric insofar as is possible, complete penetration into the interspaces of the base fabric by the coating composition being important in order to achieve maximum adhesion and bonding therebetween.

The fabric F saturated with the coating composition leaves the nip of the pressure roller pair 18*a*, 18*b* and passes to a curing oven 20 which is maintained at a temperature sufficient to impart a gelled condition to the applied coating so that the same no longer sticks to itself so that the initially coated fabric can be handled for further processing without difficulty, but the oven temperature is not sufficiently high at this stage to achieve curing of the initial base coating, except in an alternative embodiment which will be described subsequently. A typical operating temperature for the curing oven 20 is about 300°–315° F. A minimum drying time at this temperature is about 2½ minutes, although it will be readily understood by the skilled worker that the heating time and temperature can be varied somewhat in inverse relation to one another. From the curing ofen, the base fabric carrying the coating in gelled condition thereon is passed to a winder 22 where it is collected in a roll for further processing.

At the end of the first coating stage, the starting weight of the base fabric has been increased by the weight of the applied coating and, for example, with a preferred fabric having a weight of 6 oz/yd$^2$, a satisfactory base coating weight would be an additional 6 oz to give a total weight for the coated fabric at this stage of about 12 oz/yd$^2$. It will be understood that the effect of the curing is to set up the coating composition so that it does not sag or flow off of the base fabric but remains in an essentially stabilized gel-like condition, although as mentioned, the coating has preferably not undergone full curing at this time.

In order to achieve inventive membranes having particularly advantageous and even optimum combinations of mechanical properties, the invention contemplates the addition to the base coated fabric of the first stage described above of additional layers or coats of the same coating composition in order to create an ultimate coating of increased thickness and weight. To this end, the intermediate stage product from the first stage of FIG. 1 is processed in accordance with the flow sheet set forth diagrammatically in FIGS. 2 and 3 so as to receive at least one subsequent exterior coating or layer on each of its original surfaces. Thus, the base coated fabric collecte in roll form from the first stage is mounted on an unwinding reel 30 and passed to a coating head generally designated 32 which preferably takes the form of a knife-over-roller coating unit. In this unit, the coated fabric designated CF passes over a backing roller 34 and underneath coating knife 36 having its lower edge separated from the backing roller periphery by a clearance space determined by the amount of coating desired to be applied to the fabric CF. A supply of the coating composition, preferably constituted identically with the original formulation, although obviously some variation is possible within the scope of the invention, is delivered from a supply hopper 38 via a conduit 40 having at one end a gate valve 42 which allows the fresh coating composition to be deposited in a mass on the fabric CF upstream of the knife 36. As the fabric passes through the coating head 32, knife 36 spreads the supplementary coating material $C_S$ in the form of a thin layer over the surface of the fabric, an excess mass of the supplemental coating $C_S$ being held forwardly of the knife and spreading under its own flowing tendency over the width of the fabric. The now further coated material is advanced through a so-called double pass curing oven 44, in which it makes a re-entrant bend around two spaced apart guide rollers 46 and emerges from the same side of the oven as it entered.

The temperature of oven 44 will depend upon the number of passes that are contemplated for the application of additional layers of the coating composition. For a total say of 5 ultimate passes, the oven temperature would increase in graduated steps, for example, as follows:

Pass 1—380° F.
Pass 2—430° F.
Pass 3—470° F.
Pass 4—475° F.
Pass 5—485° F.

For a lesser number of passes, different temperatures may be employed, but the above values will serve to illustrate the general operative range from which such values would be selected. The length of the oven can, of course, be varied; an oven 22 yards in length from its entry to the periphery of the interior guide rolls 46 to give a total dwell length of 44 yards has been found entirely satisfactory under the conditions stated here.

After each pass through oven 44, the supplementary coated fabric CF is delivered through an embossing station generally designated 46 consisting of a smooth surfaced top roller 50 and a bottom roller 48 which carries an embossing pattern appropriate to give a matte or finely grained pebbled appearance to one side of the coated fabric. After embossing, the embossed fabric moves to a cooling stage generally designated 52 which is constituted by a plurality, say 3–5 or more, cooling cans 54*a, b* and *c,* which are journalled for free rotation so as to divert the fabric along a generally sinuous path during cooling, the can being maintained at approximately 42° F. by coolant passed through the interior or other means, all known in the art. The cooled fabric is finally collected in a reel on a take-up or winder 58.

As is apparent, the term "curing" is used in a broad sense here, covering both the initial solidification of the base coating to a generally gel-like condition in the phase 1 coating as well as the more intense heating steps used in the various passes of the second stage heating. Strictly speaking, the term "curing" is a misnomer in the present invention, PVC being a thermoplastic resin and not undergoing any cross linking or hardening chemical reaction normally envisoned by the use of this term. More precisely, the selection of the temperatures of the various coating passes is associated with the fusion of the coating composition, the final and highest of these temperatures being sufficiently hot as to bring the entire coated material to substantially the fusion temperature of the coating so that all of the secondary layers fuse and merge with one another as well as with the original base coating, producing ultimately the effect of a single unitary coating of the ultimate weight and thickness. The lower temperatures of the preceding passes should be above the highest temperature of the preceding passes but below the complete fusion temperature of the final pass. It is only by this substantially complete fusion that the desired high mechanical properties of the ultimate membrane are developed, and application of lower final temperatures will be reflected in some loss in mechanical properties.

The membrane of the invention in an intermediate stage condition following processing according to the arrangement of FIG. 2 is shown in cross section in FIG. 3 wherein the original base-coated base fabric is designated CF and the coating which has been applied to the upper side thereof by the FIG. 2 arrangement is designated $C_T$, this coating serving ultimately as the top coating of the fabric although as shown in FIG. 3, it is present on the underside of the base-coated base fabric CF in readiness for further processing to apply a coating to the opposite side of the base-coated base fabric by passing the material in inverted condition in at least one and preferably more than one pass again through the second stage coating arrangement as depicted in FIG. 4.

Mention has already been made of the application of an additional coating layer to each face of the base coated fabric and, consequently, after the initially base coated fabric has applied thereto one or more additional layers on a first of its two sides, such additional layers on the same side being deposited by repetition of the above described secondary coating step, except for a slight increase in curing temperature, the additional coated fabric must be inverted and passed at least one and preferably more than one time through the secondary coating stage of FIG. 3. The inversion of the material naturally serves to result in the application of the supplemental coating to its side opposite that which received the initially applied supplemental coating. Although a minimum of one additional supplemental coating on each fabric side will suffice for certain less demanding utilities for the membranes of the invention, the preferred practice is to apply at least two and optimally three coatings on the initially coated face and two coatings on the back face. With the embossing roller unit arranged as illustrated and described, although all of the coating layers are subjected to the embossing action of embossing roller 50, the embossment of the initially applied coatings is removed during the embossment of the subsequently applied coatings on the inverted material, inasmuch as the coating composition emerges from the oven in fairly softened condition so that the smooth peripheral surface of backing roller 48 is in effect superimposed upon the initial embossment and "smooths" out the same. Thus, one surface of the ultimate multi-stage coated fabric has a generally smooth slick texture, this surface being designated the facing side, while the opposite surrace has a matte texture created by the embossment roller, being referred to as the back or reverse side.

The temperatures mentioned above for the curing oven are selected so that the supplemental or secondarily applied coatings in the FIG. 2 coating stage assume a fused condition while passing through the curing oven so as to become integrally united with all previously applied coatings, only the final curing step being set sufficiently high as to achieve ultimate curing of the overall coating composition. The result of the application of supplemental or additional coating layers is simply to produce a coating of increased overall weight beyond that which is possible by mere immersion coating due to the inherent limitations on the amount of coating material that can be picked up by the fabric upon immersion. The control of the heating or curing of the additional or supplemental layers is such, however, that these layers do not exist as distinct strata but become fully integrated with prior and subsequent coatings so as to avoid any problems of delamination of the same.

Figure 5:
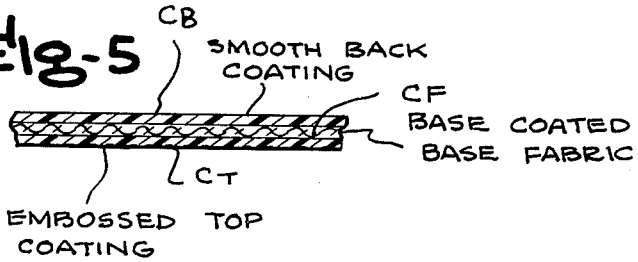
FIG. 5 is an enlarged detailed cross-sectional view of the coated fabric generally in the condition following the FIG. 4 treatment.
Figure 6:
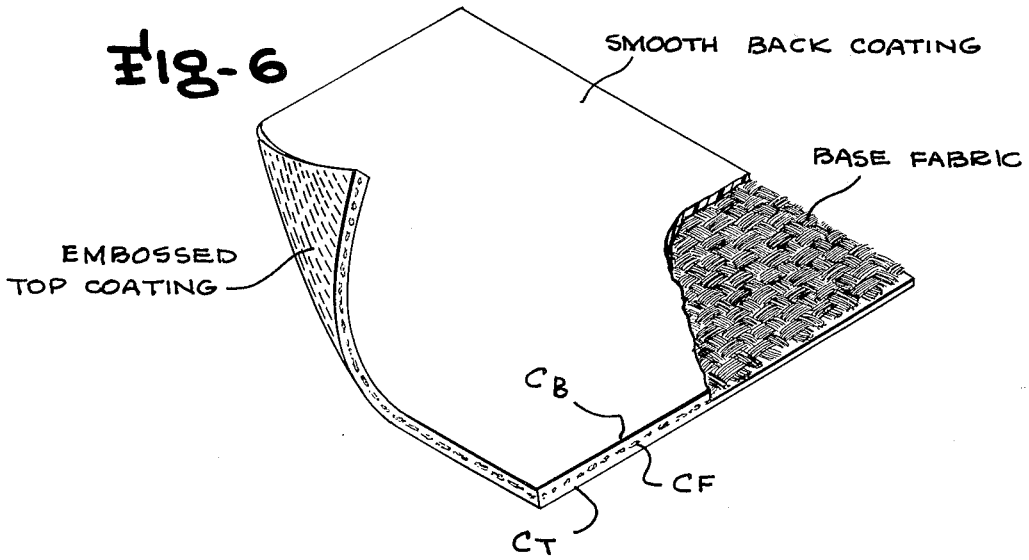
FIG. 6 is an enlarged detail perspective view of a swatch of the membrane of the present invention, partially cut away to reveal the base fabric present in the interior thereof.

The final condition of the preferred membrane of the present invention is shown in cross-sectional detail in FIG. 5. In this condition, the base-coated base fabric CF carries on its underlying surface a backing coating $C_B$ which has an embossed texture and appearance thereon and on its upper or top surface a top coating $C_T$ has a smooth or slick appearance, the embossed pattern originally imparted thereto having been subsequently pressed out by the action of smooth surfaced top roller 50 of the embossing stage 46 when the intermediate stage material is passed in inverted condition through the second stage coating arrangement.

The amount of the additional or supplemental coatings applied to the opposite sides of the base coated fabric can, of course, be equalized if desired, but preferably is disproportionate so that the surface which ultimately constitutes the face side (having the slick smooth texture) receives 65% of the overall added coating weight, while the surface which ultimately serves as the back face receives 35% of that weight. The amount of supplemental coating composition $C_S$ applied in the second stage coating unit of FIG. 2 can vary widely dependent upon the number of passes envisioned, which can be multiplied with a corresponding reduction in the weight of applied coating if desired, but, as a minimum, when supplemental coating is practiced, 3 oz of supplemental coating, distributed partly on each of the opposite sides of the base coated fabrics, would be needed while the maximum of coating could perhaps go as high as 40 oz in addition to the starting weight of the base fabric and the weight of the initially applied base coating. At the latter level, of course, the fabric would exhibit considerably increased thickness and weight with correspondingly improved mechanical properties as might be useful for certain particularly severe working environments. In general, however, a useful amount of supplemental coating is 18 oz, based on a base fabric weighing 6 oz and a base coating of 6 oz, distributed in the preferred proportion and number of coatings described above, to give a total fabric weight of 30 oz/yd$^2$.

The effect of the additional or supplemental coatings is not merely to increase the weight of the fabric alone but to achieve significantly increased levels in mechanical properties. Thus, the additional coatings improve abrasion resistance, resistance to penetration by moisture, resistance to degradation by exposure to UV radiation, to heating and light, to mechanical impact, and to tearing or bursting. It hardly needs to be explained that the magnitude of the added improvement of these properties corresponds at least generally with the amount of the supplemental coating provided. Thus, the products of different grades or durability are possible within the scope of the invention allowing the consumer added flexibility as to cost in relation to expected ultimate performance. In general, the low temperature flexibility achieved according to this invention is independent of variations in coating thickness, the heavier coated fabrics when constituted in the proper manner exhibiting equally acceptable flexibility at considerably reduced temperatures as those of lesser thickness.

The pressure selected for the embossing unit can vary in accordance with the skill of this art but, by way of example, an embossing pressure of around 35,000 lb/in$^2$ has been found quite satisfactory and at these levels, the embossing unit also exerts a modest laminating action which is believed to be desirable.

Although the application of at least one additional or supplemental coating by means of the second coating stage of FIG. 2 represents the preferred execution of the invention, that can be dispensed with for the production of a minimum cost product with correspondingly reduced durable life and mechanical properties. In this case, the intermediate drying oven 20 of the first coating stage of FIG. 1 would be operated at increased temperature so as to impart a hardened or cured state to the base coating composition applied at the immersion stage, utilizing temperatures similar to those described in connection with the final stage of curing oven 44 of the second coating stage of FIG. 2. This minimum product would consist of the base fabric fully impregnated with the base coating composition and carrying continuous coatings of the same along its opposite sides, and minimum performance standards would be achieved by this arrangement in that all of the constituents which confer the combination of mechanical properties desired are already present in this product. The difference is essentially that the amounts of these constituents do not correspond to those which impart the preferred magnitudes of the mechanical properties under consideration. Thus, for example, enough of the opacifying pigment is present to cover the yarns of the base fabric and shield the same to some extent from heat and light degradation, but such shielding action is necessarily far below that which is optimum and is imparted when significantly larger amounts of that ingredient are provided by the addition of the supplemental coatings.

EXAMPLE:

A preferred example of the present invention utilizes the preferred base fabric described above, namely, 1000 denier bundles of polyester yarns each containing 192 individual filaments are woven into a fabric at a pick density of 24×26 to produce a base fabric having a weight of 6 oz/yd$^2$ and a thickness of 11–12 mils. This base fabric is impregnated with the following coating formulation:

| Ingredient | % by weight |
|---|---|
| Polyvinyl resin | 43.7 |
| n-octyl, n-decyl trimellitate | 19.7 |
| Epoxidized soybean oil plasticizer | 2.2 |
| Ba—Ca—Zn heat stabilizer | 2.2 |
| Polymeric polyester plasticizer | 2.2 |
| Tricresyl phosphate plasticizer | 4.4 |
| Antimony oxide fire retardant | 18.6 |
| 2-hydroxy, 4-n-octyl benzophenone UV stabilizer | .0066 |
| 2-n-octyl, 4-isothiazoline fungicide | .013 |
| Titanium dioxide pigment | 4.4 |
| Mineral spirits diluent | 2.85 |

The base fabric is initially saturated by immersion with the above coated composition to pick up 6 oz/yd$^2$ of the same which is heated to gel state as described. The base coated fabric is then given 5 additional supplemental coats in the manner illustrated and described in connection with FIGS. 2 and 3, 3 of such coats being applied to the face side and 2 to the back side, the temperatures of the curing oven for the several passes being as specified above with the curing cans chilled to the already stated temperature. The total amount of supplementary applied coating material equals 18 oz, of which about 65% is applied to the face coat and about 35% is applied to the back face of the material, these amounts being divided equally for the 3 and 2 bases, respectively, for the opposite sides.

This product exhibits the following average physical properties:

| | |
|---|---|
| Thickness ins. (min.) Method ASTM 751 | 30.0 mils |
| Tongue Tear (lbs.) (min.) Method 5134 | 90 × 90 |
| Grab tensile, lbs. Method 5100 | 390 × 390 |
| Hydrostatic Resist., psi (min.) Method 5512 | 500 |
| Low temperature cold crack, ASTM D-2136, ⅛" mandrel | −30° F. No crack |
| Puncture resistance, psi Mullen burst | 450 |
| Moisture vapor transmission ASTM E-96 | TBD |

The above product has excellent utility as a roofing fabric constituting the sole fabric applied over a plywood or other board roofing subsurface and exhibits durability in the order of 10 or more years. The product can also be applied directly over existing gravel roofing and will tolerate a reasonable amount of foot traffic thereover without deterioration due to abrasion or the like. Indeed, the fabric in question will resist rupture when pounded against the gravel by means of a rubber surfaced hammer under force sufficient to crush the underlying gravel aggregate, although a metal headed hammer will have some tendency to cut or punch through the fabric in question.

The product of this example has been exposed to a weatherometer of the known type used in textile testing for as long as 3,000 hours and after such exposure exhibited no loss in flexibility of appreciable change in the mechanical properties of the coat. The fabric in question fully satisfies the low temperature flexibility test described above, readily withstanding without any type of cracking or crazing whatsoever a 180° bend on a radius of 1/16 inch as specified.

What is claimed is:

1. A durable flexible membrane comprising:

(1) a generally heavy and dense supporting and reinforcing reticular base fabric formed of thick generally loose bundles each containing a large multiplicity of individual continuous filaments of a synthetic polymer characterized by generally high dimensional stability and resistance to heat and light, said multi-filament bundles being arranged in mechanically interengaged intersecting relation with interstices therein, said base fabric having a weight of substantially about 3–12 oz/yd$^2$; and (2) a solidified base coating composition completely impregnating the interstices of said base fabric and continuously coating the opposite sides thereof, which composition consists essentially of polyvinyl chloride resin and as a plasticizing agent for said resin about 35–100% by weight thereof of a trimellitate ester which exhibits high resistance to separation from said resin and imparts to the coating high flexibility at temperatures not higher than about −30° F., said coating composition being present in an amount sufficient to impregnate the interior and form continuous coating on the opposite sides of said base fabric.

2. The membrane of claim 1 wherein said coated and impregnated base fabric includes on opposite sides thereof at least one additional layer of said coating composition fused in integral relation to the base coating surface, the aggregate weight of said additional layers on both sides equalling at least about 50% of said base coating weight.

3. The membrane of claim 2 wherein the aggregate weight of said additional layers is divided in the ratio of about 2:1 between the upper and lower surfaces of said base coating.

4. The membrane of claim 1 wherein said trimellitate ester is a di- or trialkyl ester each alkyl group of which contains at least about 6 carbon atoms in a straight chain.

5. The membrane of claim 4 wherein said plasticizing agent is n-octyl, n-decyl-trimellitate.

6. The membrane of claim 1 wherein said coating composition also includes minor amounts of a heat and light stabilizing agent, a UV resistance improving agent, a fire retardant, an opacifying pigment, and a fungicide, all for said polyvinyl chloride resin.

7. The membrane of claim 1 wherein said PVC resin is a homopolymer having an intrinsic viscosity of about 1.0–1.4.

8. The membrane of claim 7 wherein said PVC resin includes up to about 50% its weight of a blending resin therefor.

9. The membrane of claim 1 wherein one of said coated surfaces is embossed to a substantially matte condition.

10. The member of claim 1 wherein said base coating is present in an amount at least equal to the weight of said base fabric.

11. A process for producing a durable flexible membrane which comprises (a) saturating with a base coating composition a generally heavy and dense supporting and reinforcing reticular base fabric, said base fabric being formed of thick generally loose bundles each containing a large multiplicity of individual continuous filaments of a synthetic polymer characterized by generally high dimensional stability and resistance to heat and light, said multi-filament bundles being arranged in mechanically interengaged intersecting relation with interstices therein, the base fabric having a weight of substantially about 3–12 oz/yd$^2$, to completely impregnate the interstices of said base fabric and form on its opposite sides continuous coatings of said composition, said composition consisting essentially of polyvinyl resin and as a plasticizing agent for said resin about 35–100% of its weight of a trimellitate ester which exhibits high resistance to separation from said resin and imparts to the coating high flexibilities at temperatures not higher than about −30° F.; and (b) heating the thus applied coating composition to a temperature sufficient to dry and cure the same.

12. The process of claim 11 wherein the coating saturating said base fabric is dried to a generally gelled condition and thereafter at least one additional coating layer of said coating composition is applied to each of the opposite surfaces of said coated fabric and then heated at a sufficiently high temperature to fuse each subsequently applied coating to the underlying coating surface, and then drying and curing the final coated product.

13. The process of claim 12 wherein at least two additional layers of said coating composition are applied to each of the opposite sides of the originally coated fabric, the aggregate amount of the applied coatings being substantially equal to the aggregate weight of the base fabric and original coating.

14. The process of claim 11 wherein said trimellitate ester is a di- or trialkyl ester each alkyl group of which contains at least about 6 carbon atoms in a straight chain.

15. The process of claim 14 wherein said plasticizing agent is n-octyl, n-decyl-trimellitate.

16. The process of claim 11 wherein said coating composition also includes minor amounts of a heat and light stabilizing agent, a UV resistance improving agent, a fire retardant, an opacifying pigment, and a fungicide, all for said polyvinyl chloride resin.

17. The process of claim 11 wherein said PVC resin is a homopolymer having an intrinsic viscosity of about 1.0–1.4.

18. The process of claim 17 wherein said PVC resin includes up to about 50% its weight of a blending resin therefor.

19. The process of claim 12 wherein one such additional coating after being heated is subjected to a mechanical embossing step in order to impart to one side of the ultimate membrane a generally matte texture.

20. The process of claim 11 wherein said base coating is present in an amount at least equal to the weight of said base fabric.

* * * * *